US006405711B1

(12) United States Patent
Smith et al.

(10) Patent No.: US 6,405,711 B1
(45) Date of Patent: Jun. 18, 2002

(54) FUEL DELIVERY MODULE FOR FUEL INJECTED INTERNAL COMBUSTION ENGINES

(75) Inventors: Daniel Frederick Smith, Conesus; Michael Roland Brosseau, Rochester; Curtis David Lamb, Scottsville, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/626,495

(22) Filed: Jul. 27, 2000

(51) Int. Cl.[7] ..... F02M 37/04

(52) U.S. Cl. ..... 123/456; 123/509; 123/468

(58) Field of Search ..... 123/456, 468, 123/469, 470, 508, 509

(56) References Cited

U.S. PATENT DOCUMENTS

| | | | | | |
|---|---|---|---|---|---|
| 4,480,613 | A | | 11/1984 | Siewert | |
| 4,615,323 | A | * | 10/1986 | Leblanc et al. | 123/509 |
| 4,771,754 | A | | 9/1988 | Reinke | |
| 5,398,658 | A | * | 3/1995 | Mesimaki | 123/509 |
| 5,482,021 | A | * | 1/1996 | Roche | 123/456 |
| 6,009,855 | A | * | 1/2000 | Espey | 123/456 |
| 6,042,028 | A | | 3/2000 | Xu | |
| 6,213,096 | B1 | * | 4/2001 | Kato et al. | 123/456 |

* cited by examiner

*Primary Examiner*—Thomas N. Moulis
(74) *Attorney, Agent, or Firm*—John VanOphem

(57) ABSTRACT

An integrated fuel delivery module for a fuel injected engine includes a fuel rail having a fuel distribution channel and a plurality of spaced-apart fuel injector sockets connected with the fuel distribution channel. A high-pressure fuel pump has a high-pressure chamber connected internally to the fuel distribution channel without external high-pressure fuel lines.

17 Claims, 5 Drawing Sheets

FUEL DELIVERY MODULE FOR FUEL INJECTED INTERNAL COMBUSTION ENGINES

TECHNICAL FIELD

This invention relates to a fuel pump and fuel delivery module arrangement for fuel injected internal combustion engines.

BACKGROUND OF THE INVENTION

Various fuel injection systems for internal combustion engines have been developed. One type of system includes a plurality of fuel injection nozzles that inject fuel into the intake passageways leading to the combustion chamber. Alternately, fuel may be directly injected into the engine combustion chambers. In such direct injection (DI) systems, high fuel pressures are required to overcome compression pressures in the chamber and to generate very fine fuel atomization. Required fuel pressures for direct injection gasoline engines are on the order of 10 MPa (about 1500 PSI). Further, diesel engines may require much higher fuel pressures, on the order of 67 MPa (about 10,000 PSI). in contrast, fuel injection systems having fuel injected into the intake runner (upstream of the intake valve) operate at relatively low fuel pressures, on the order of 0.3 MPa (about 40 PSI).

Existing direct injection systems generally include a fuel rail having a plurality of fuel injector sockets supplying fuel to the fuel injectors. A high-pressure fuel pump supplies fuel to the fuel rail through a high-pressure fuel line that is connected to the rail and the fuel pump by high-pressure fittings. However, various problems may be encountered with such an arrangement. For example, fuel leakage at the fittings and the like may occur with such systems. Further, the fuel line and fittings require fabrication and installation/assembly, thus adding to the cost and complexity of the vehicle.

SUMMARY OF THE INVENTION

One aspect of the present invention is an integrated high-pressure fuel pump and fuel delivery module for fuel injected internal combustion engines. A fuel delivery module includes a fuel rail having a fuel distribution channel and a plurality of spaced-apart fuel injector sockets connected with the fuel distribution channel. A high-pressure fuel pump has a high-pressure chamber connected internally to the fuel distribution channel without external high-pressure fuel lines.

Another aspect of the present invention is an internal combustion engine of the type having a plurality of combustion chambers and an intake system supplying air to the combustion chambers. The intake system includes an intake manifold having a plurality of intake ports configured to supply air to the combustion chambers. A plurality of fuel injectors supply fuel to a selected one of the intake ports and the combustion chambers. A fuel rail extends along the intake manifold, and includes a fuel distribution channel supplying fuel to the fuel injectors. A fuel pump is mounted on the fuel rail, and has a high-pressure chamber connected internally to the fuel distribution channel without external fuel lines.

Yet another aspect of the present invention is an integrated fuel pump and fuel rail for fuel injected internal combustion engines. A fuel rail has an elongated fuel distribution channel and a plurality of spaced-apart fuel injection sockets connected to the fuel distribution channels. A fuel pump has a high-pressure chamber connected internally to the fuel distribution channel. The fuel pump includes a housing, at least a portion of which is integrally formed with the fuel rail.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
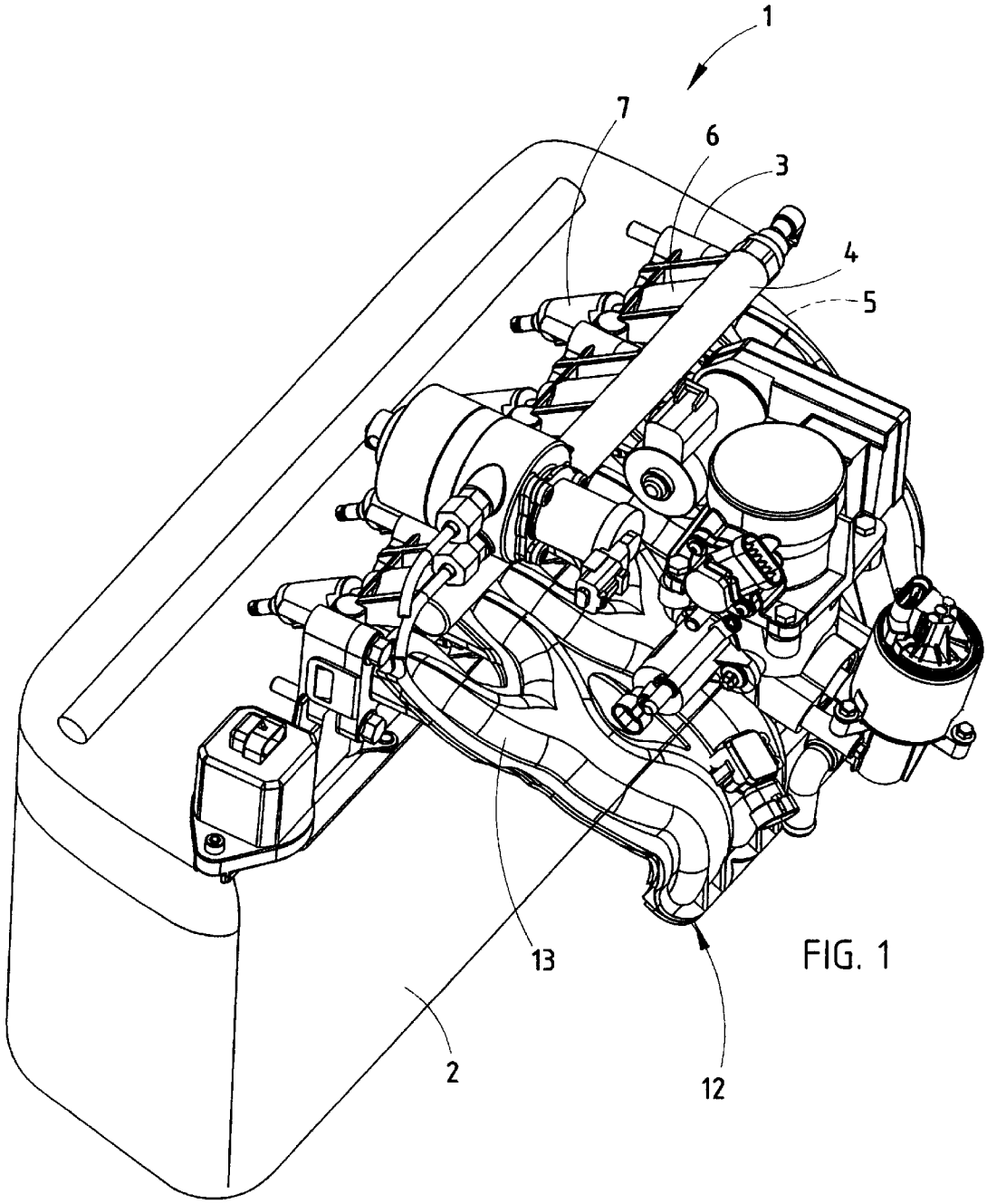
FIG. 1 is a partially schematic, perspective view of an internal combustion engine including an integrated high-pressure fuel pump and fuel delivery module embodying the present invention.

For purposes of description herein, the terms "upper," "lower," "right," "left," "rear," "front, " "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
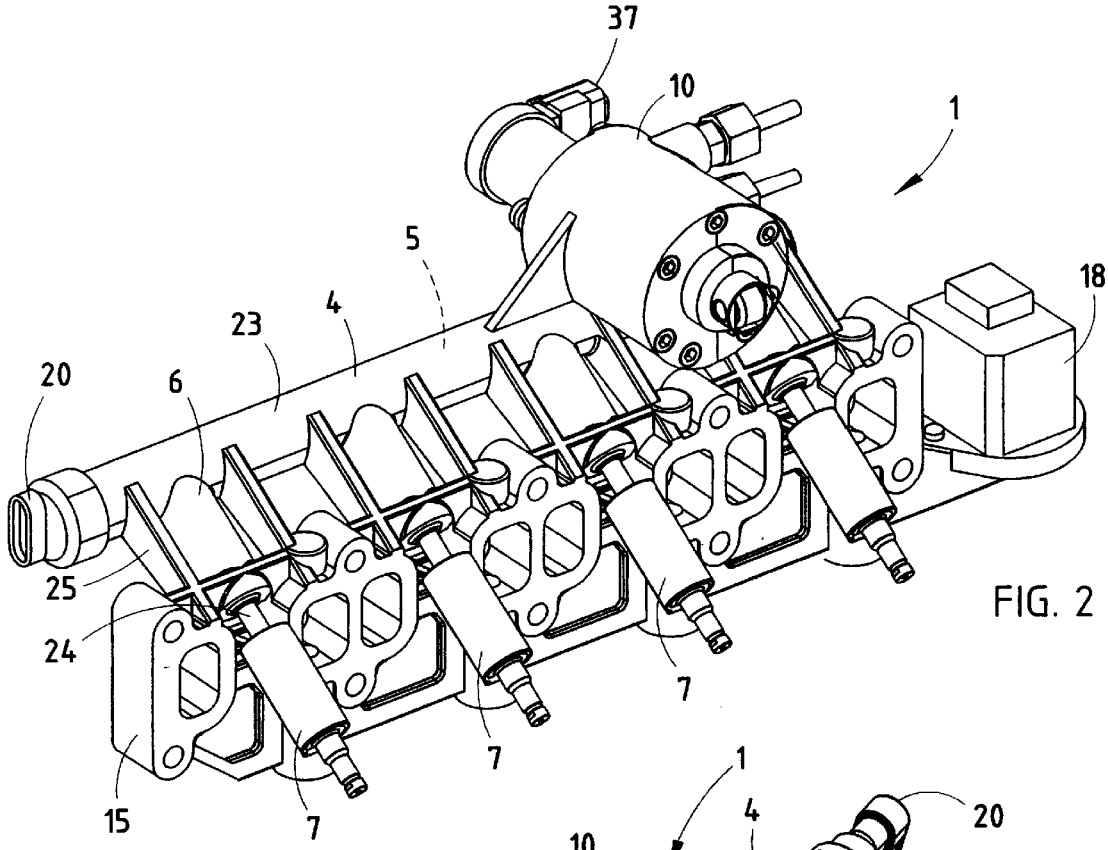
FIG. 2 is a partially fragmentary, perspective view of an integrated high-pressure fuel pump and fuel delivery module according to one aspect of the present invention.

The reference numeral 1 (FIG. 1) generally designates an integrated high-pressure fuel pump and fuel delivery module for a fuel injected internal combustion engine 2. In the illustrated example, the integrated high-pressure fuel pump and fuel delivery module 1 includes a fuel delivery module 3 having a fuel rail 4 forming a fuel distribution channel 5 and including a plurality of spaced-apart fuel injector sockets 6 (see also FIG. 2) connected with the fuel distribution channel to supply fuel to a plurality of fuel injector nozzles 7. A high-pressure fuel pump 10 includes a high-pressure chamber 11 (FIG. 5) connected internally to the fuel distribution channel 5 without external high-pressure fuel lines.

Figure 3:
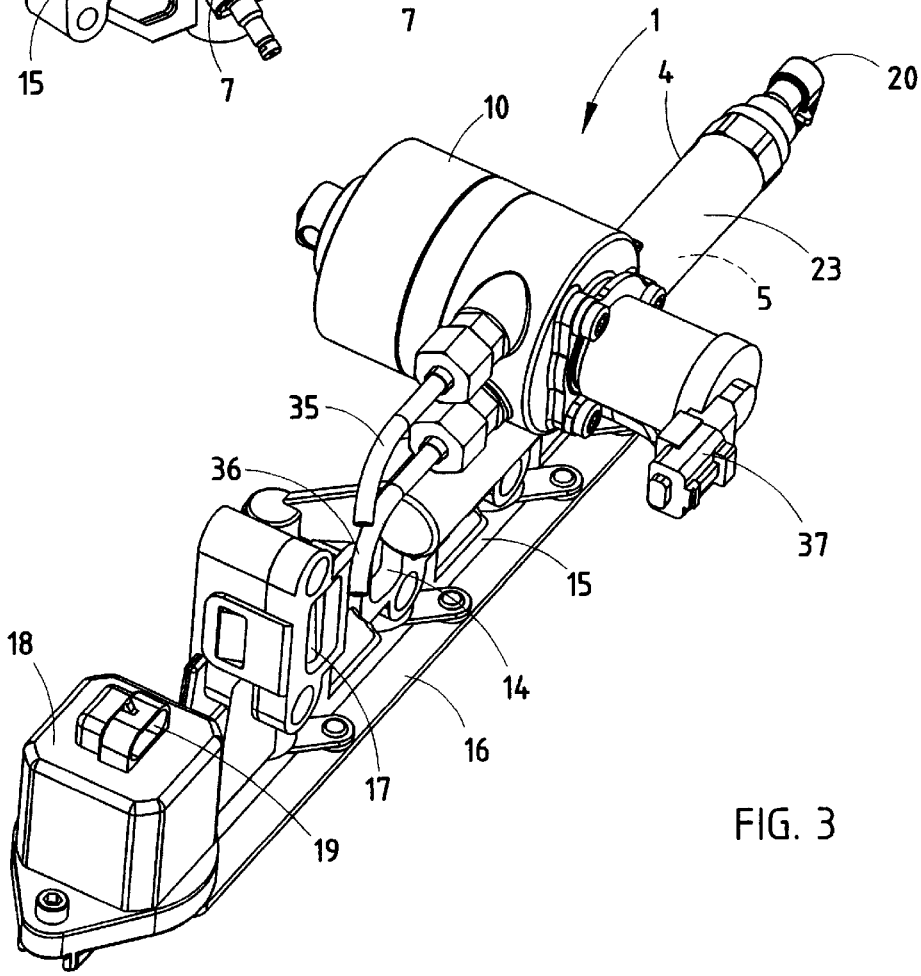
FIG. 3 is a partially fragmentary, perspective view of an integrated high-pressure fuel pump and fuel delivery module according to one aspect of the present invention.

Internal combustion engine 2 includes an intake manifold 12 having a plurality of intake runners or passageways 13 that connect with the ports 14 (FIG. 3) of a second intake manifold part 15. A mechanical linkage 16 operates conventional throttle valves 17 located within each port 14. A conventional electrical actuator 18 includes an electrical connector 19 for receiving signals from the engine control unit (ECU) (not shown) to control the linkage 16 and throttle valves 17. Throttle valves 17 are of a conventional "flow control" or "port throttle" valve design. A fuel pressure sensor 20 is positioned at one end of the fuel rail to provide a signal to the ECU corresponding to the fuel pressure within the fuel distribution channel 5 of fuel rail 4. The fuel injector nozzles 7 are direct injection type injectors, wherein the fuel is injected directly into the combustion chamber 21 of engine cylinder head 22 (see also FIG. 4).

Fuel rail 4 includes a tubular main section 23 forming fuel distribution channel 5 therein. Fuel injector sockets 6 are also generally tubular, and extend transversely from the tubular main portion 23 of rail 4. Sockets 6 include a conventional connector 24 to distribute the fuel to the fuel injector nozzles 7. A plurality of reinforcing ribs 25 (FIG. 2) extend parallel to the fuel injector sockets 6, and rigidly interconnect the second intake manifold part 15 with the tubular main portion 23 of fuel rail 4. Significantly, fuel rail 4, fuel injector sockets 6, second intake manifold part 15, and ribs 25 may all be integrally cast as a one piece unit that can be readily assembled to the cylinder head 22 of internal combustion engine 2.

Figure 4:
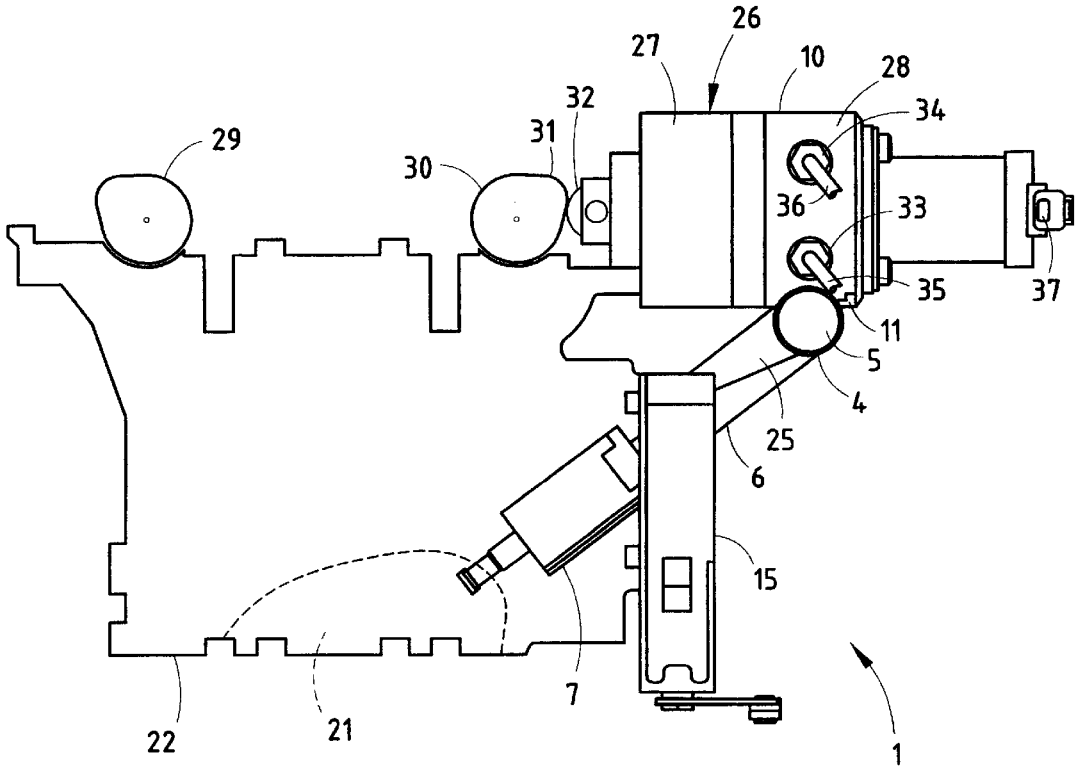
FIG. 4 is a partially schematic view of the integrated high-pressure fuel pump and fuel delivery module of FIG. 1 taken along the axis of the cam.
Figure 5:
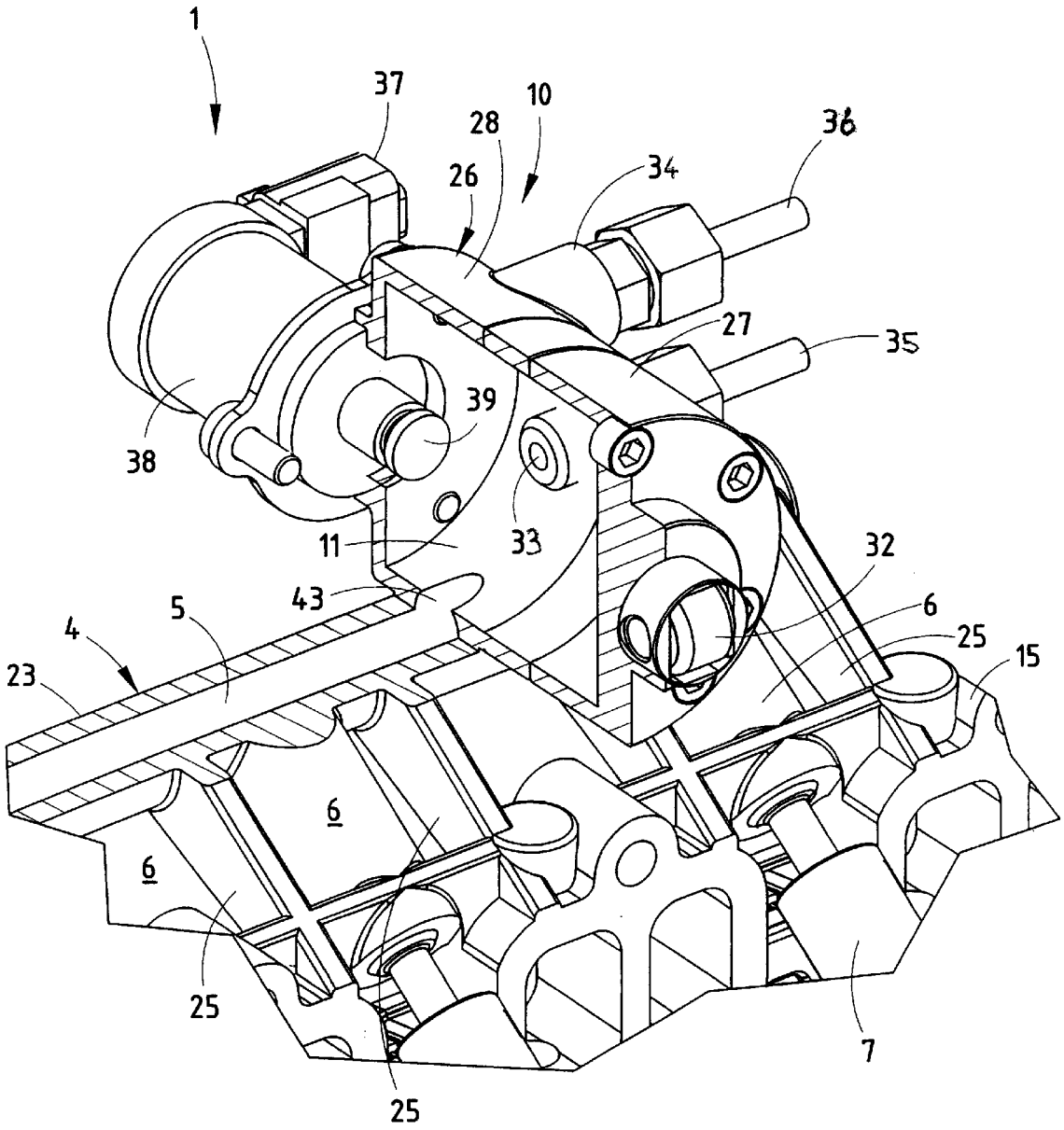
FIG. 5 is a fragmentary, perspective view of the high-pressure fuel pump and delivery module of FIG. 1 illustrating the integral fuel rail and pump housing.

High-pressure fuel pump 10 includes a housing 26 having a first portion 27, and a second portion 28 that is formed integrally with the fuel rail 4 (see also FIG. 5). Opening 43 directly connects high-pressure chamber 11 of pump 10 with channel 5 of rail 4 without fittings. Alternately, the fuel pump 10 could be connected to the fuel rail 4 by a high-pressure fitting without use of an external fuel line. However, in a preferred construction second housing portion 28 is integrally cast with rail 4 to completely eliminate external fittings and fuel lines between pump 10 and rail 4. A preferred material for rail 4 and integral fuel pump housing 28 is a "high density" cast aluminum. In the illustrated example, internal combustion engine 2 includes overhead cams 29 and 30 (FIG. 4). Cam 30 includes a cam lobe 31, and pump 10 includes a cam follower 32 that engages lobe 31 to actuate pump 10. Alternately, pump 10 could be mechanically driven by other known arrangements, or, pump 10 could be an electrical pump. Pump 10 includes a low-pressure fuel supply port 33 that is connected to a low-pressure fuel supply line 35 via a conventional threaded connectors. Pump 10 further includes a low-pressure fuel return port 34 connected to a low-pressure fuel return line 36, also via conventional threaded connectors. Pump 10 includes an electrical connector 37 for receiving/sending electrical signals to the ECU. Electrical connector 37 is connected to a fuel pressure sensor and regulator assembly 38 that senses the pressure of the fuel within chamber 11, and returns fuel to the fuel tank (not shown) of the vehicle through the low-pressure return line 36. The regulator assembly 38 includes a sensor 39 extending into chamber 11 to sense the fuel pressure within chamber 11. Housing 28 of fuel pump 10 is integrally formed with fuel rail 4, such that the fuel return line 36 can be routed directly from the fuel pump 10 to the fuel tank, rather than from the fuel rail 4.

Figure 6:
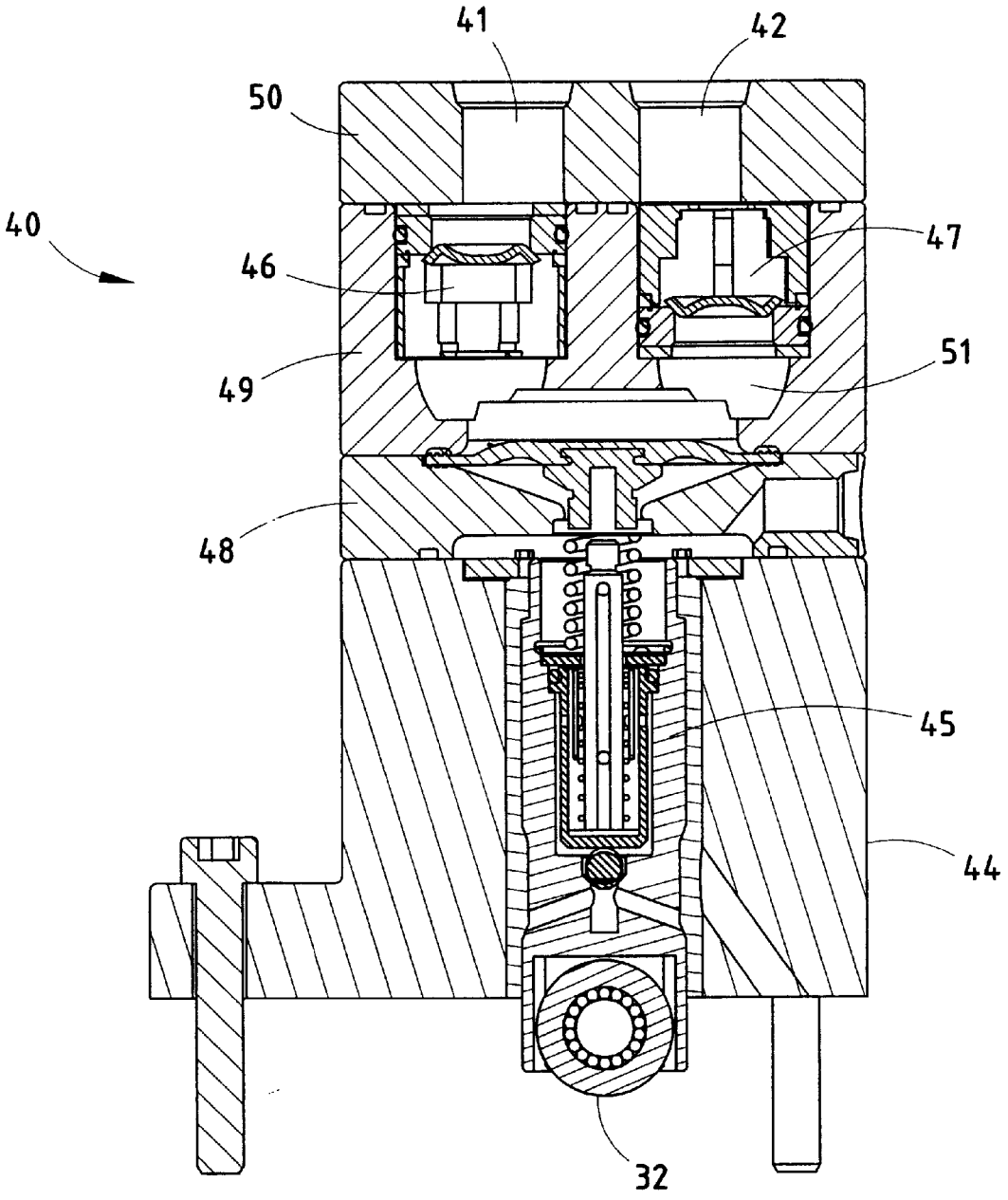
FIG. 6 is a cross-sectional view of a diaphragm type pump suitable for use with the integrated fuel pump housing and rail of FIGS. 1–5.

Pump 10 could have various internal mechanical or electrical pump configurations. FIG. 6 illustrates an existing diaphragm fuel pump 40 having a pump design usable with the integrated fuel rail and housing of the present invention. The pump 40 of FIG. 6 is described in detail in U.S. patent application No. 09/027,121, filed Feb. 20, 1998, entitled HYDRAULIC DIAPHRAGM PUMP, the entire contents of which are hereby incorporated herein by reference. Although the various internal components of pump 40 would be rearranged somewhat to fit within the housing 26 of the present fuel pump 10, the operation of the internal components is substantially the same as illustrated in FIG. 6. Inlet port 41 and outlet port 42 correspond to the supply port 33 and opening 43, respectively, of pump 10 of the present invention (FIG. 5). Accordingly, the routing of ports 41 and 42 would be changed to match ports 41 and 42. Although the housing 27 of the present pump 10 is illustrated with a relatively thin sidewall in FIG. 5, the actual internal dimensions of housing 27 would be substantially the same as housing 44 of pump 40 illustrated in FIG. 6, such that housing 27 would accommodate the follower 32 and internal pump components 45. The pump 40 of FIG. 6 includes housing portions 49, 50, and 51, as well as inlet and outlet valve assemblies 46 and 47 that route the fuel through the internal passageways 51 of pump 40. Pump 10 of the present invention could utilize substantially the same valve assemblies 46 and 47, as well as the various other internal passageways 51 and related components. However, housing portion 28 would have an internal configuration providing for internal passageways 51, valves 46 and 47, and other internal components configured to-pump fuel from the supply port 33 to the opening 43 into fuel distribution channel 5. Numerous mechanical or electrical pump designs could be utilized with the integral fuel pump housing and fuel rail of the present invention, such that pump 40 merely illustrates one example of a cam-driven mechanical pump suitable for use with the present integrated fuel pump housing and delivery module. Clearly, electrical fuel pumps that are not cam-driven could also be utilized.

The integrated fuel pump and fuel delivery module of the present invention eliminates external high-pressure connections and lines, thus improving reliability while reducing the possibility of leakage. Further, elimination of the high-pressure external fittings and lines reduces the complexity and attending cost associated with conventional arrangements. In the illustrated example, internal combustion engine 2 is a direct injection gasoline engine. However, the integrated high-pressure fuel pump and fuel delivery rail and module of the present invention may also be utilized with high-pressure diesel engines, or low-pressure gasoline fuel injection systems wherein fuel is injected upstream of the intake valves.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An integrated high-pressure fuel delivery module, comprising:

a one piece integral unit including an intake manifold part having a plurality of intake ports configured to flow air to a cylinder head, and a fuel rail having a fuel distribution channel and a plurality of space-apart fuel injector sockets connected with said fuel distribution channel;

said one piece integral unit further including a pump housing and a high-pressure fuel pump having a high-pressure chamber connected internally to said fuel distribution channel without external high-pressure fuel lines.

2. An integrated high-pressure fuel delivery module for connection to a high-pressure fuel pump having a high-pressure chamber connected internally to said fuel distribution channel without external high-pressure fuel lines for an engine, said fuel delivery module comprising a fuel rail having a fuel distribution channel and a plurality of spaced-apart fuel injector sockets connected with said fuel distribution channel; and wherein said fuel pump includes a follower adapted to connect a cam lobe to actuate said fuel pump.

3. The integrated fuel delivery module set forth in claim 1, wherein said fuel pump includes a low-pressure fuel supply port and a low-pressure fuel return port.

4. The integrated fuel delivery module set forth in claim 1, wherein said fuel delivery module includes a plurality of injectors adapted to directly inject fuel into a combustion chamber of an associated internal combustion engine.

5. The integrated fuel delivery module set forth in claim 4, wherein said fuel pump generates fuel pressure on the order of at least 1500 psi.

6. The integrated fuel delivery module set forth in claim 1, wherein:

said fuel rail includes an elongated tubular portion forming said fuel distribution channel; and said fuel pump is positioned on and above said elongated tubular portion.

7. An internal combustion engine of the type having a plurality of combustion chambers and an intake system supplying air to said combustion chambers, said intake system comprising:

an intake manifold part including a plurality of intake ports configured to supply air to the combustion chambers;

a plurality of fuel injectors supplying fuel directly to said combustion chambers;

a fuel rail extending along said intake manifold and formed integrally therewith, said fuel rail including a fuel distribution channel supplying fuel to said fuel injectors; and a fuel pump mounted to said fuel rail and having a fuel pump housing formed integrally with said fuel rail, said fuel pump having a high-pressure chamber connected internally to said fuel distribution channel without external fuel lines.

8. The internal combustion engine set forth in claim 7, wherein said fuel rail and said portion of said housing are integrally cast of a metal material.

9. The internal combustion engine set forth in claim 7, wherein:

said internal combustion engine includes at least one camshaft configured to actuate intake valves of said engine, said camshaft including at least one pump actuation lobe; and said fuel pump includes a follower contacting said pump actuation lobe to actuate said fuel pump.

10. The internal combustion engine set forth in claim 9, wherein said fuel pump generates fuel pressure on the order of at least 1500 psi.

11. The internal combustion engine set forth in claim 10, wherein:

said fuel rail includes an elongated tubular portion forming said fuel distribution channel; and said fuel pump is positioned on and above said elongated tubular portion.

12. An integrated fuel delivery module for a fuel injected engine, comprising:

an intake manifold part having a plurality of intake ports configured to supply air to combustion chambers of an internal combustion engine;

a fuel rail formed integrally with said intake manifold part and having an elongated fuel distribution channel and a plurality of spaced-apart fuel injection sockets connected to said fuel distribution channel; and a fuel pump having a high-pressure chamber connected internally to said fuel distribution channel, said fuel pump including a housing, at least a portion of which is integrally formed with said fuel rail.

13. An integrated fuel pump and fuel rail for a fuel injected engine, comprising:

a fuel rail having an elongated fuel distribution channel and a plurality of spaced-apart fuel injection sockets connected to said fuel distribution channel; and a fuel pump having a high-pressure chamber connected internally to said fuel distribution channel, said fuel pump including a housing, at least a portion of which is integrally formed with said fuel rail, said fuel pump including a follower adapted to contact a cam lobe to actuate said fuel pump.

14. The integrated fuel delivery module set forth in claim 12, wherein said fuel pump includes a low-pressure fuel supply port and a low-pressure fuel return port.

15. The integrated fuel delivery module set forth in claim 12, wherein said fuel delivery module includes a plurality of injectors adapted to directly inject fuel into a combustion chamber of an associated internal combustion engine.

16. The integrated fuel delivery module set forth in claim 15, wherein said fuel pump generates fuel pressure on the order of at least 1500 psi.

17. The integrated fuel delivery module set forth in claim 16, wherein:

said fuel rail includes an elongated tubular portion forming said fuel distribution channel; and said fuel pump is positioned on and above said elongated tubular portion.

* * * * *